US011805846B2

(12) United States Patent
Swigart et al.

(10) Patent No.: US 11,805,846 B2
(45) Date of Patent: Nov. 7, 2023

(54) ARTICLE OF FOOTWEAR WITH TRACTION SYSTEM

(71) Applicant: Acushnet Company, Fairhaven, MA (US)

(72) Inventors: John F. Swigart, Portland, OR (US); Robert S. Bento, Raynham, MA (US); Paul O. Teeter, Pembroke, MA (US)

(73) Assignee: Acushnet Company, Fairhaven, MA (US)

( * ) Notice: Subject to any disclaimer, the term of this patent is extended or adjusted under 35 U.S.C. 154(b) by 67 days.

(21) Appl. No.: 17/497,275

(22) Filed: Oct. 8, 2021

(65) Prior Publication Data

US 2023/0112333 A1 Apr. 13, 2023

(51) Int. Cl.
*A43B 13/22* (2006.01)
*A43B 13/14* (2006.01)

(52) U.S. Cl.
CPC ..... *A43B 13/223* (2013.01); *A43B 13/145* (2013.01)

(58) Field of Classification Search
CPC ... A43B 13/223; A43B 13/145; A43B 13/141; A43B 13/143; A43B 13/146
See application file for complete search history.

(56) References Cited

U.S. PATENT DOCUMENTS 2,317,020 A * 4/1943 Banister ..... A63B 25/06 36/7.5
4,041,619 A * 8/1977 Sapper ..... A43B 13/145 36/103
4,241,523 A * 12/1980 Daswick ..... A43B 13/181 36/32 R
4,375,728 A * 3/1983 Dassler ..... A43B 13/223 36/114
4,393,604 A * 7/1983 Crowley ..... A43C 15/162 36/126
4,402,145 A * 9/1983 Dassler ..... A43B 13/223 36/129
4,689,901 A * 9/1987 Ihlenburg ..... A43B 3/0042 36/114
6,076,283 A * 6/2000 Boie ..... A43B 13/223 D2/951
6,782,639 B1 * 8/2004 Muller ..... A43B 13/145 36/117.4
6,857,205 B1 * 2/2005 Fusco ..... A43B 13/141 36/31
7,234,250 B2 * 6/2007 Fogarty ..... A43B 13/223 36/61
7,584,554 B2 * 9/2009 Fogarty ..... A43C 15/168 36/61
7,913,425 B2 * 3/2011 Fogarty ..... A43C 15/168 36/61
8,079,160 B2 * 12/2011 Baucom ..... A43C 15/14 36/61

(Continued)

*Primary Examiner* — Bao-Thieu L Nguyen
(74) *Attorney, Agent, or Firm* — Williams Mullen; F. Michael Sajovec

(57) ABSTRACT

An article of footwear with a traction system. The traction system includes a plurality of traction elements of various heights on the outsole that undergo rotation within the penetrated substratum while avoiding damage from digging the surface while walking. The plurality of traction elements has a shortened height at pivot points of a foot and a lengthened height away from the pivot points of the foot.

18 Claims, 6 Drawing Sheets

(56) References Cited

U.S. PATENT DOCUMENTS

| | | | | |
|---|---|---|---|---|
| 8,256,145 | B2 * | 9/2012 | Baucom | A43C 15/14 36/61 |
| 9,532,623 | B2 * | 1/2017 | Kilgore | A43B 13/14 |
| 2005/0072026 | A1 * | 4/2005 | Sink | A43C 15/168 36/134 |
| 2005/0081405 | A1 * | 4/2005 | Healy | A43B 13/223 36/59 C |
| 2006/0174518 | A1 * | 8/2006 | Fogarty | A43B 13/223 36/61 |
| 2008/0010859 | A1 * | 1/2008 | Fogarty | A43C 15/14 36/61 |
| 2010/0024250 | A1 * | 2/2010 | Fogarty | A43B 13/223 36/61 |
| 2010/0146825 | A1 * | 6/2010 | Teteriatnikov | A43B 13/145 36/30 R |
| 2011/0252669 | A1 * | 10/2011 | Kasprzak | A43B 13/223 36/67 A |
| 2013/0000183 | A1 * | 1/2013 | Adkins | C10G 3/49 502/68 |
| 2014/0047740 | A1 * | 2/2014 | Tucker | A43B 13/223 36/83 |
| 2015/0033582 | A1 * | 2/2015 | Colpack | A43B 23/0215 12/142 E |
| 2017/0238656 | A1 * | 8/2017 | Hurd | A43B 13/223 |
| 2019/0313733 | A1 * | 10/2019 | Bartel | B29D 35/142 |
| 2022/0225729 | A1 * | 7/2022 | Bonin | A43B 13/145 |

* cited by examiner

ARTICLE OF FOOTWEAR WITH TRACTION SYSTEM

FIELD OF THE DISCLOSURE

The disclosure relates generally to the field of footwear. More specifically, the disclosure relates to the field of footwear with a traction system.

BACKGROUND

Spikeless golf shoes have been increasing in popularity as they provide several advantages over their spiked counterparts, including increased comfort and versatility. In efforts to improve traction, these shoes have increased the aggressiveness of their spikeless outsole aesthetics (including rising size, jaggedness and number of traction elements). However, the increased aggressiveness of these traction elements has come at the cost of damaging golf greens due to penetration of the traction elements into the ground substratum of the greens.

SUMMARY

To this end, the present disclosure provides for an article of footwear with high traction that reduces damage to surfaces, such as a golf green, while walking and playing golf. The following presents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

Accordingly, one aspect of the present disclosure is directed to an article of footwear configured to provide stability and traction while walking on a surface. In some embodiments, the article of footwear may comprise an upper, an outsole, a midsole and a traction system. The traction system may include a plurality of traction elements of various heights on the outsole. The traction elements have a shortened height at pivot points of a foot and a lengthened height away from the pivot points of the foot. While walking, the traction elements undergo rotation within the penetrated ground substratum while avoiding damage from digging the surface while walking. The plurality of traction elements may have a shortened height at pivot points of a foot and a lengthened height away from pivot points of the foot.

These and other aspects will become apparent to those skilled in the art after a reading of the following description when considered with the drawings.

BRIEF DESCRIPTION OF THE DRAWINGS

Illustrative embodiments of the present disclosure are described in detail below with reference to the attached drawing figures and wherein.

DETAILED DESCRIPTION

Figure 1:
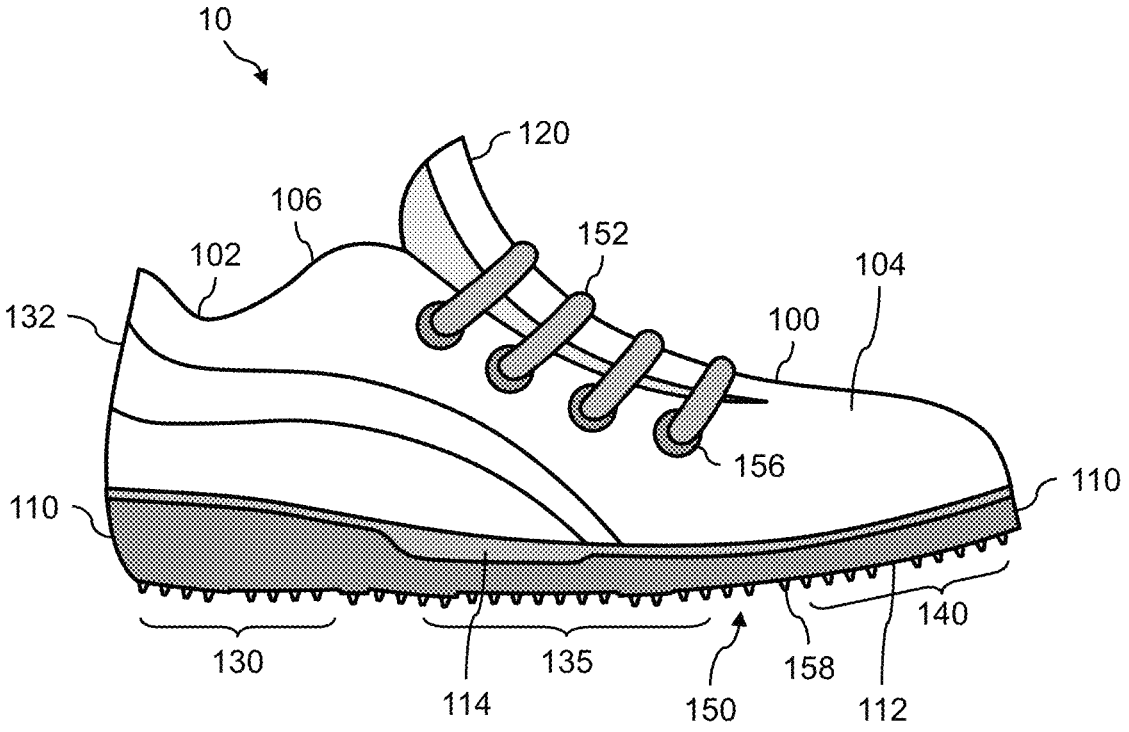
FIG. 1 is a side view of an article of footwear according to one embodiment.

Several embodiments will be described more fully in reference to the accompanying figures. However, this disclosure should not be construed as limited to the embodiments set forth herein. Rather, these embodiments are provided so that this disclosure will be thorough and complete, and will fully convey the scope of the invention to those skilled in the art. In the drawings, like numbers refer to like elements throughout. Thicknesses and dimensions of some components may be exaggerated for clarity.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "attached," "coupled" or "connected" to another element, it can be directly attached, coupled or connected to the other element or intervening elements may also be present. In contrast, when an element is referred to as being "directly attached," directly coupled" or "directly connected" to another element, there are no intervening elements present.

All patents, patent applications and publications referred to herein are incorporated by reference in their entirety. In case of a conflict in terminology, the present specification is controlling.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Referring now to FIG. 1, an article of footwear 10 for is provided. The article of footwear provides traction while reducing damage on a walking surface (e.g., a golf green). The article of footwear may include an upper 100 and a sole 110. The article of footwear 10 may further include a heel region 130, a forefoot region 140 and a traction system 150.

The heel region 130 may generally correspond with the rear portions of a foot, namely, the area surrounding and below the Achilles tendon, the posterior of the heel, and the talus and calcaneus bones. A forefoot region 140 may generally correspond with a front of a foot, namely, the toes and metatarsal, phalange, and sesamoid bones. A midfoot region 135 may generally correspond with a middle of the foot, namely, the arch and the navicular, cuboid, and cuneiform bones. It is understood that the heel region 130, midfoot region 135, and forefoot region 140 are intended to represent general areas of footwear and not demarcate precise areas.

The article of footwear 10 may have a medial side that extends from a forefoot region 140 to a heel region 130 and a lateral side that extends from a forefoot region 140 to a heel region 130. The lateral side and the medial side may be opposite one another. In some embodiments, the lateral side and medial side may be generally parallel to one another. The lateral side may generally correspond to an outside area of a foot and a surface that faces away from a user's other foot. The medial side may generally correspond with an inside area of a foot and a surface that faces toward a user's other foot.

The upper 100 may have an interior surface 102 and an exterior surface 104. The interior surface 102 may partially define an area configured to receive a user's foot. The upper 100 may be configured to extend over a user's foot, along the medial and lateral sides of the foot, and around a forefoot region and a heel region of the foot. The area configured to receive a user's foot may be accessed from an ankle opening defined by a collar 106. The footwear 10 may include a tongue 120

The upper 100 may be constructed from any appropriate material now known or later developed, including, but not limited to, leather, suede, fabric, canvas, weaves, knits, man-made polymer fibers, nylon, polyester, or cotton. The upper 100 may be elastic. Alternately, at least a portion of the upper 100 may be elastic. In other embodiments, the upper 100 may be inelastic. The upper 100 includes at least a portion that is inflexible and is rigid or semi-rigid.

The upper 100 may further include a heel counter 132 at the heel region 130. The heel counter 132 may reinforce the upper 100 and limit movement of a user's heel. The heel counter 132 may wrap around the heel region 130 and extend forward along both the lateral side and the medial side.

The footwear may include one or more closure systems for securing a user's foot, the selection of which is within the skill of one in the art. Examples of closure systems may include any suitable closure system including conventional laces, a lace tightening system as described in U.S. Pat. No. 10,070,695 and incorporated herein by reference in its entirety, and a closure system as described in U.S. application Ser. No. 17/355,390 filed Jun. 23, 2021 and incorporated herein by reference in its entirety. For example, the closure system may comprise a lace 152 above the upper 100 and configured to interact with the outer surface of the upper 104. The lace 152 may be entirely or partially visible. In other embodiments, the lace guides 156 may be placed such that the lace 152 is not in direct contact with the upper 100.

In some embodiments, the lace 152 may be between an exterior surface of the upper 104 and an interior surface of the upper 102. In such embodiments there may be a channel for the laces between the exterior surface of the upper 104 and the interior surface of the upper 102. The lace guides 156 may also be positioned between the exterior surface of the upper 104 and the interior surface of the upper 102.

In some embodiments, a portion of the lace 152 may be between an exterior surface of the upper 104 and an interior surface of the upper 102, and a portion of the lace 152 may be above an exterior surface of the upper 104.

In some embodiments, the sole 110 of the footwear 10 may include an outsole 112, a midsole 114, and an insole (not shown). The sole 110 may be coupled to the upper 100 at a bite line 105. The sole 110 may be configured to attenuate forces or provide support or cushioning.

In some embodiments, the midsole 114 may be formed from a compressible material that provides cushioning. In other embodiments, the midsole 114 may comprise plates or be formed from dense materials to increase stability. The outsole 112 may be below the midsole 114 and may be designed to interact with a ground surface.

The insole may be designed to provide cushioning or comfort for a user. The insole may be removable and may be above the midsole 114 when in use. In some embodiments, the insole may be designed to provide support. The insole may be flexible, semi-rigid, or rigid.

The outsole 112 may include a traction system 150 designed to impart traction. In some embodiments, the traction system 150 may comprise a plurality of traction elements 158. The traction elements may be releasably or fixedly coupled to the outsole 112. The traction elements 158 may be formed or molded into elements such as a spike or nub with polymers such as rubbers, thermal polyurethane, polyamides, and high density forms such as ethylene-vinyl acetate and SEBS. The traction elements may be any type of traction element now known or later discovered. For example, the traction system may be comprised of traction elements as disclosed in US Publication Nos. 2020/0383421, 2020/0383422, 2020/0077734, 2020/0146389, which are incorporated herein by reference in their entireties. In some embodiments, the traction system may be comprised of a combination of different types of traction elements, including those described in the publications above.

Figure 2A:
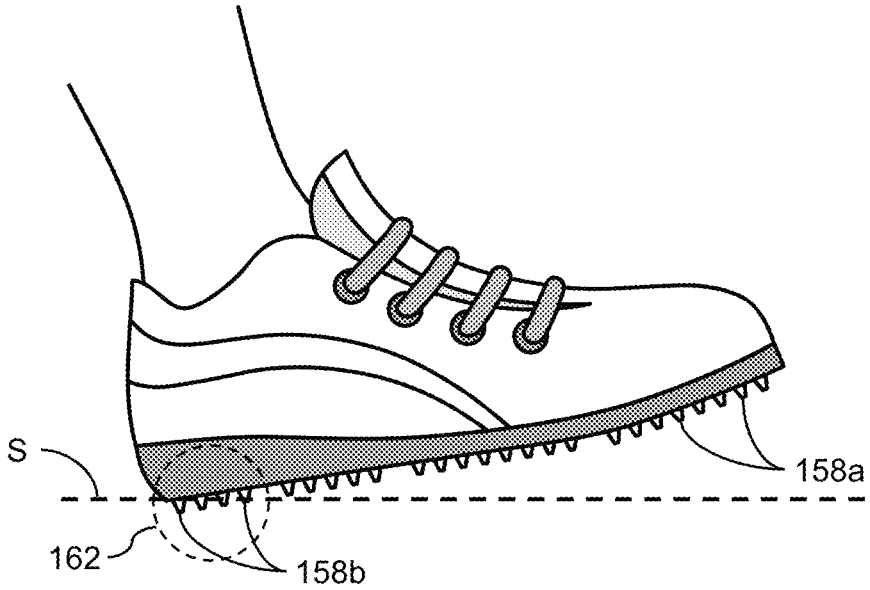
FIG. 2A (Prior Art)
FIG. 2A, FIG. 2B and FIG. 2C depict prior art footwear and the various stages of walking and the pivot points at each stage in relation to the substratum of the ground.
Figure 2B:
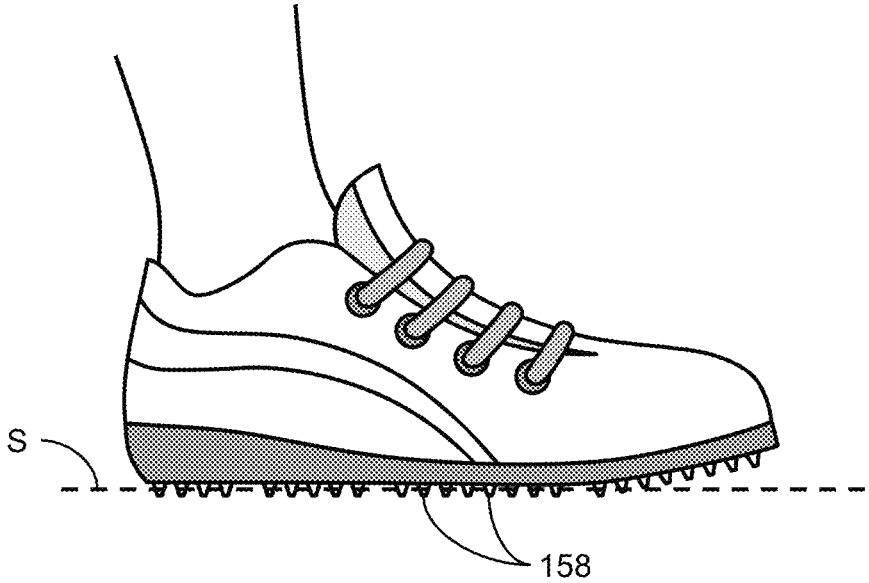
FIG. 2B (Prior Art)
Figure 2C:
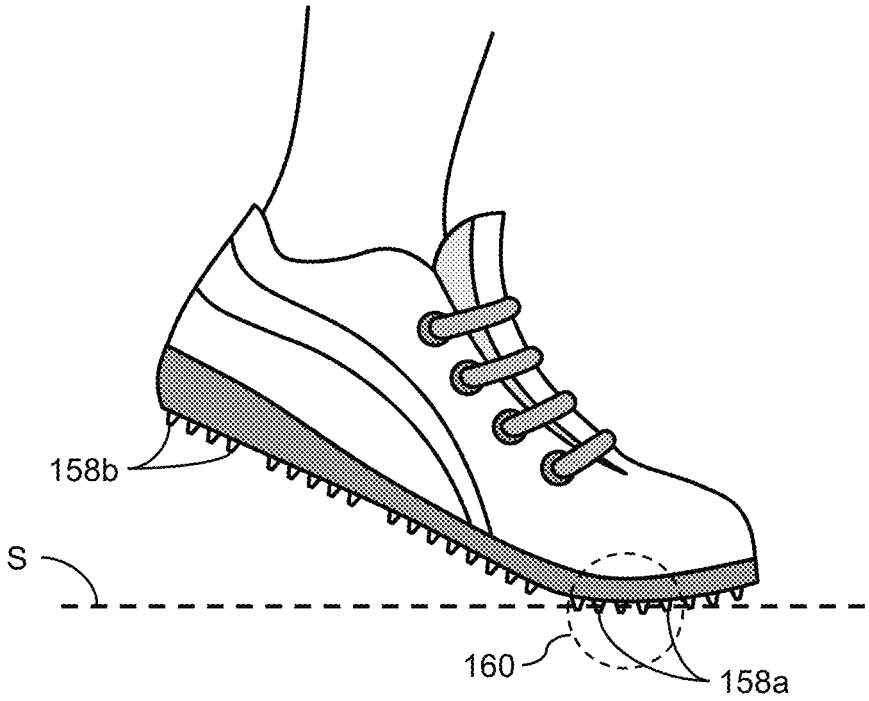
FIG. 2C (Prior Art)

Referring to FIGS. 2A-2C, various pivot points of golf footwear are illustrated, and show how conventional prior art traction elements dig into ground substratum S of a golf course. This digging into the substratum S may be damaging to the ground and particularly the ground of putting greens. In FIG. 2A, the heel of the foot contacts the green while walking the golf course via traction elements 158*b* on the lateral posterior edge of the heel at pivot point 162. As the heel is weighted, the traction elements penetrate the course surface. As the foot rotates from heel strike to stance phase of the gait cycle, the fully penetrated heel traction elements 158*b* at heel pivot point 162 rotate concomitantly within the substratum of the green. In FIG. 2B in the stance phase, all traction elements 158*b* are seated into the green substratum S. In FIG. 2C, the fully penetrated heel traction elements 158*a* begin to rotate away from the surface of the green at about pivot point 160 as the user pushes off of the forefoot in. During support-foot forefoot dorsiflexion the traction elements 158*a* near the pivot point 160 rotate in substratum S at front toe pivot point 164, resulting in digging. The present invention may avoid this damaging digging into the substratum S by minimizing penetration.

Figure 3:
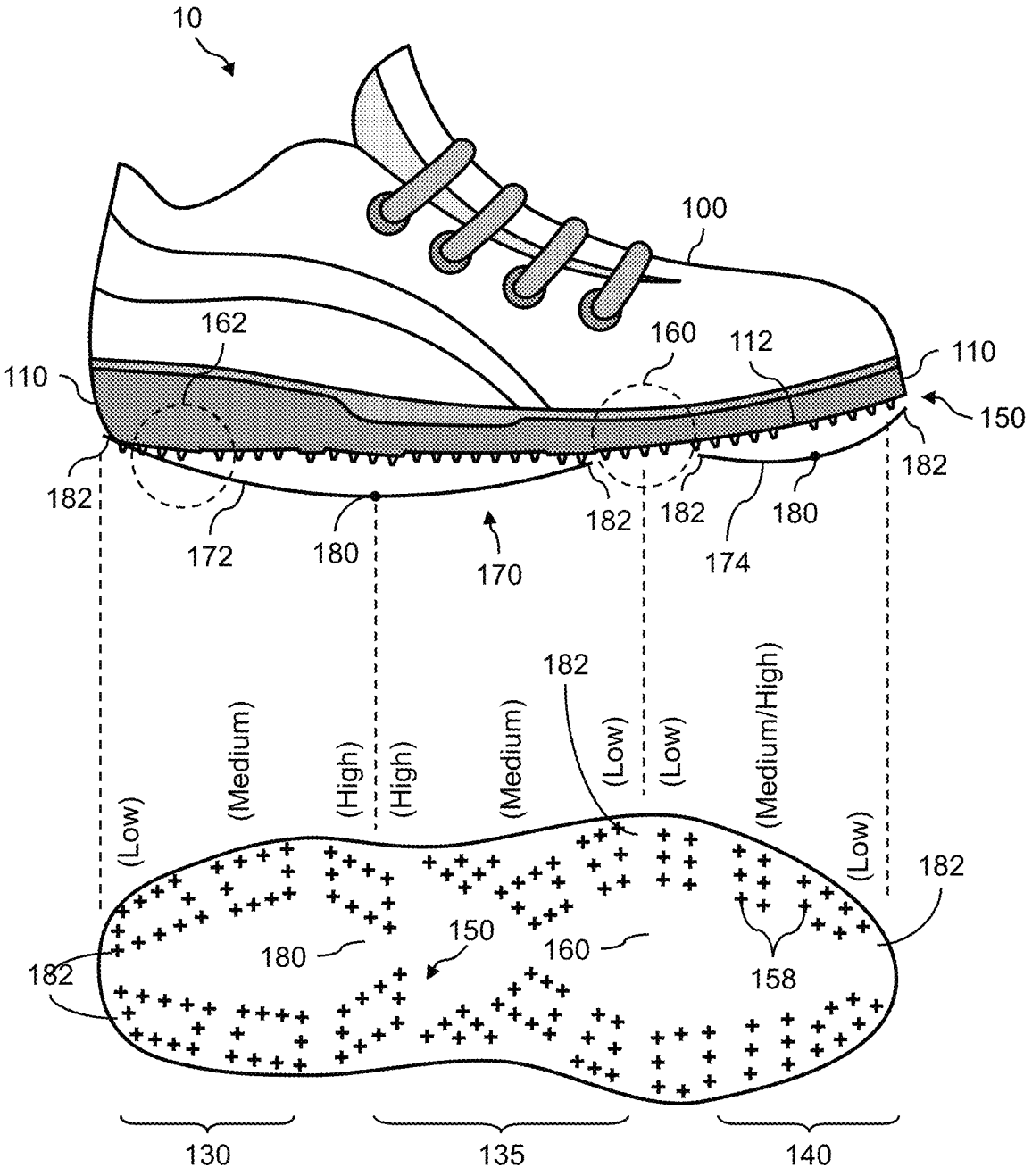
FIG. 3 is a diagram of a side elevation view and a bottom elevation view of the article of footwear indicating positioning of the parabolic arcs.

Referring to FIG. 3, a solution to digging the substratum S of a green during walking is illustrated. In general, the footwear of the present invention includes reduced traction element height near contact rotation locations (pivot points) and increased traction element height away from contact rotation locations. In some embodiments, the traction elements 158 may form one or more parabolic arcs 170 along the outsole 112. The parabolic arcs may be formed based on the heights of the traction elements 158. Traction elements 158 with a shortened or minimum height may be positioned at the ends 182 of the parabolic arcs 170. Traction elements 158 at the peaks 180 of the parabolic arcs may have a lengthened or maximum height in relation to the other traction elements. The traction elements between the peak and ends of the parabolic arcs may have a medium height ranging between the minimum and maximum defined heights and vary from low to high depending on placement as shown in FIG. 3.

Figure 4:
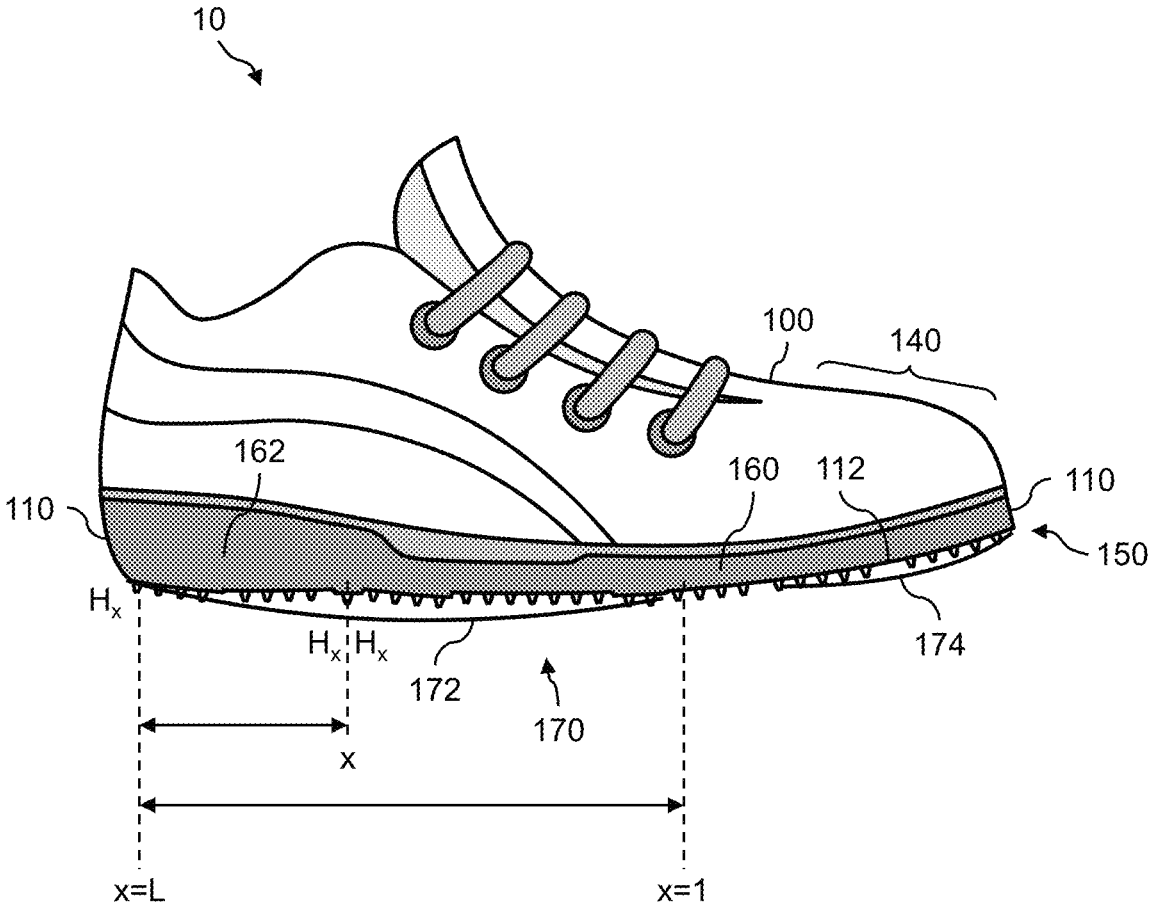
FIG. 4 is an enlarged side view and bottom view of the article of footwear in FIG. 3 showing various parameters for a parabolic arc.

Outsole 112 may have a first parabolic arc 172 and a second parabolic arc 174. The parabolic arcs 170 may have identical arcs. In other embodiments, the parabolic arcs 170 may vary in one or more ways. Referring to FIG. 4, a first parabolic arc 172 may have a first predetermined length $L_1$ and a second parabolic arc 174 may have a second predetermined length $L_2$ and the lengths between the two may differ. In some embodiments, a length ratio $L_R$ may be defined as:

$$L_R = L_1 : L_2$$

In some embodiments, the length ratio between the first parabolic arc and the second parabolic arc may be between about 4:1 and 2:1. For example, the first parabolic arc 172 may have a length between about 190 and 210 mm. The second parabolic arc may have a length between about 90 and 110 mm. However, the length ratio may vary in other embodiments based on factors such as the shoe size of the article of footwear.

Parabolic arcs 170 may also vary in other manners. For example, the parabolic arcs 170 may each vary in minimum height $H_m$, maximum height $H_{max}$, area, width, number of traction elements, density of traction elements, curvature of both the traction element and of the sole and/or overall size and shape of the traction elements. Each traction element 158 may have a height ranging from about 1 to 8 mm. In some embodiments, the plurality of traction elements 158 may have a minimum height $H_m$ between about 1 and 4 mm. In some embodiments, the plurality of traction elements 158 may have a maximum height $H_{max}$ between about 4 and 7.5 mm.

Certain embodiments of the outsole 112 may include parabolic arcs 170 separated by one or more flat regions (not shown) on the outsole 112. For example, the flat regions may be comprised of traction elements substantially identical in height. The flat region may alternatively be formed from the outsole 112 itself.

In some embodiments, parabolic arcs 170 may be positioned based on pivot points 160, 162 and 164. The slope of the parabolic arcs 170 may increase away from pivot points 160, 162 and 164. For example, as seen in FIG. 3, the traction elements 158 may form a first parabolic arc 172 from forefoot pivot point 160 to heel pivot point 162 and a second parabolic arc 174 from forefoot pivot point 160 to the front toe pivot point 164. In some embodiments, the first parabolic arc 172 may be formed within the heel region 130 and midfoot region 135. The second parabolic arc 174 may be formed at the forefoot region 140. Some embodiments of the traction system 150 may utilize more than two parabolic arcs 170. For example, the outsole 112 may have a first parabolic arc 172 formed within the heel region 130, a second parabolic arc 174 formed within the forefoot region 140 and a third parabolic arc (not shown) formed within the midfoot region 135.

The arrangement of traction elements 158 as parabolic arcs 170 may be useful for increased traction, while at the same time, minimizing damage to walking surfaces due to penetration of the substratum S. The traction elements 158 may form parabolic arcs 170 that have the same traction as outsoles having a substantially flat surface area that require aggressive traction elements (e.g., higher number of traction elements, increased jaggedness and size). The parabolic arcs 170 enable high traction regardless of the type of traction element.

One method of determining traction may be by measuring the vertical contact area ratio $V_{car}$ for the outsole, which is defined as:

$$V_{car} = \frac{\sum_{i=0}^{N} T_i}{\text{Surface Area for Bottom of Outsole}}$$

wherein T is the vertical contact area for each traction element and N is the total number of traction elements. Assuming a general cylindrical shape for each traction element 158, the contact area for each traction element is defined as:

$$T = H \times D$$

wherein H is the height of the traction element and D is its diameter.

A higher $V_{car}$ indicates higher traction. Thus, one method for increasing traction is by increasing the total number of traction elements to increase $V_{car}$. Another method for increasing traction is by increasing the contact area As for each traction element, which may be done by increasing its height and/or diameter.

As seen in FIG. 4, various parameters of the parabolic arcs 170 may be modified to adjust traction. Examples of possible parameters may include the length L of the parabolic arc (wherein the reference point is defined as X=0 in FIG. 4), the average height of traction elements $H_r$, the minimum height of the traction elements $H_m$, and the maximum height $H_{max}$ of the traction elements. Articles of footwear 10 may have some parameters that vary with shoe size and/or may have one or more other parameters that are identical regardless of shoe size. For instance, the length of the parabolic arcs 170 may vary based on shoe size, wherein longer lengths of parabolic arcs 170 may be used for larger shoe sizes and shorter parabolic arc lengths may be used for smaller shoe sizes. The maximum height for the traction elements 158 may also vary based on shoe size, wherein the maximum height may be increased for larger shoe sizes and the maximum height may be decreased for smaller shoe sizes. Conversely, the minimum height may be held constant regardless of shoe sizes. These are merely provided as examples, and in other embodiments, the length of the parabolic arcs and maximum height may be held constant across shoe sizes.

The overall traction for the traction system 150 may depend on the shapes of its parabolic arcs 170. A shape factor may be defined by one or more parameters of a parabolic arc. One example of a shape factor for a parabolic arc may be defined as $$SF = \frac{6(H_m - H_r)}{L^2}$$

wherein SF is the shape factor, $H_m$ is a minimum height of the plurality of traction elements, $H_r$ is an average height of the plurality of traction elements and L is a length of the parabolic arc ($L_1$ or $L_2$). The shape factor may be correlated with the overall traction of the traction system 150. For example, the desired traction may be within a shape factor range. In some embodiments, the preferred shape factor for a first parabolic arc 172 may be between about −0.00015 and −0.00045. In some embodiments, the preferred shape factor for a second parabolic arc may be between −0.0006 and −0.00018. These ranges are based on embodiments wherein the first parabolic arc 172 is positioned around a heel pivot point 162 and the second parabolic arc 174 is positioned around a forefoot pivot point 160. Other embodiments may utilize a shape factor defined differently than the expression given above.

The preferred shape factor range may vary depending on one or more parameters, including shoe size, traction element size and the total number of parabolic arcs for a traction system. For example, the length of a parabolic arc may be increased for larger shoe sizes and therefore the desired shape factor range may be greater than that parabolic arc on a smaller shoe size. Changes in the average traction element height and/or maximum height of a traction element may also modify the overall shape of the parabolic arc and the desired shape factor range.

The lengths of parabolic arcs may be decreased for traction systems having a higher number of parabolic arcs. For example, one or more parabolic arcs for a traction system having a total of three parabolic arcs may be shorter than one or more corresponding parabolic arcs for a traction system having only two parabolic arcs in total. Thus, the shape factors for these shorter parabolic arcs would also be decreased. However, a higher number of parabolic arcs does not necessarily indicate that all parabolic arcs within that traction system are decreased in length than a traction system with a lower number of parabolic arcs. It is contemplated that certain parabolic arcs may still have a larger length in traction systems despite having a greater number of parabolic arcs.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

That which is claimed is:

1. An article of footwear, comprising:

an upper;

an outsole comprising a plurality of pivot points including a front toe pivot point, a heel pivot point, and a forefoot pivot point located between the front toe pivot point and the heel pivot point, wherein the plurality of pivot points corresponds to a plurality of locations on the outsole about which the article of footwear is configured to rotate while contacting a ground surface;

a midsole, and a traction system comprising a plurality of traction elements fixed on the outsole, the plurality of traction elements comprising (i) a first set of traction elements extending between the heel pivot point and the forefoot pivot point and (ii) a second set of traction elements extending between the forefoot pivot point and the front toe pivot point, the first set of traction elements having different heights ranging from (i) a first minimum height at or near the heel and forefoot pivot points to (ii) a first maximum height at or near a first midpoint between the heel and forefoot pivot points, wherein all of the traction elements in the first set of traction elements extend away from the outsole to a plurality of points that lie along a parabolic arc extending from the heel pivot point to the forefoot pivot point, the plurality of points positioned at a plurality of distances from the outsole, the plurality of distances corresponding to the different heights of the first set of traction elements, wherein the first maximum height corresponds to a peak of the parabolic arc, and wherein the first minimum height corresponds to one or more ends of the parabolic arc, and the second set of traction elements having different heights ranging from (i) a second minimum height at or near the forefoot and front toe pivot points to (ii) a second maximum height at or near a second midpoint between the forefoot and front toe pivot points, wherein the first set of traction elements includes a first lengthened traction element positioned at the first midpoint, the first lengthened traction element having a greater height than any other traction element in the first set of traction elements, and wherein the second set of traction elements includes a second lengthened traction element positioned at the second midpoint, the second lengthened traction element having a greater height than any other traction element in the second set of traction elements.

2. The article of footwear of claim 1, wherein the first set of traction elements is formed within a heel region and a midfoot region of the outsole and the second set of traction elements is formed within a forefoot region of the outsole.

3. The article of footwear of claim 1, wherein the plurality of traction elements have a minimum height between 1 mm and 4 mm and a maximum height between 4 mm and 7.5 mm.

4. The article of footwear of claim 1, wherein the traction system is formed from a polymer selected from the group consisting of rubber, thermal polyurethane, polyamides, ethylene-vinyl acetate, styrene ethylene butylene styrene (SEBS), and combinations thereof.

5. The article of footwear of claim 1, wherein a height of the first set of traction elements gradually increases from (i) the heel and forefoot pivot points to (ii) the first midpoint between the heel and forefoot pivot points.

6. The article of footwear of claim 1, wherein a height of the second set of traction elements gradually increases from (i) the forefoot and front toe pivot points to (ii) the second midpoint between the forefoot and front toe pivot points.

7. The article of footwear of claim 1, wherein a height of the first set of traction elements gradually decreases from (i) the first midpoint to (ii) the heel and forefoot pivot points.

8. The article of footwear of claim 1, wherein a height of the second set of traction elements gradually decreases from (i) the second midpoint to (ii) the forefoot and front toe pivot points.

9. The article of footwear of claim 1, wherein the first set of traction elements comprises (i) a first traction element having a first height, (ii) a second traction element having a second height, and (iii) a third traction element disposed between the first and second traction elements, the third traction element having a third height that is greater than the first height and the second height.

10. The article of footwear of claim 1, wherein the first set of traction elements extends along a first length $L_1$ of the outsole, and wherein the second set of traction elements extends along a second length $L_2$ of the outsole.

11. The article of footwear of claim 10, wherein a length ratio $L_R$ between $L_1$ and $L_2$ ranges from 4:1 to 2:1.

12. The article of footwear of claim 10, wherein $L_1$ is between about 190 mm and 210 mm, and wherein $L_2$ is between about 90 mm and 110 mm.

13. The article of footwear of claim 1, wherein the first set of traction elements and the second set of traction elements comprise fixed traction elements.

14. The article of footwear of claim 1, wherein the first set of traction elements and the second set of traction elements are separated or spaced apart by one or more flat or substantially flat regions.

15. The article of footwear of claim 14, wherein the one or more flat or substantially flat regions correspond to (i) a portion of the outsole or (ii) a third set of traction elements with a substantially identical or uniform height.

16. The article of footwear of claim 1, wherein each traction element between the peak of the parabolic arc and the one or more ends of the parabolic arc has a different height depending on a distance between (i) each traction element and (ii) the peak or the one or more ends of the parabolic arc.

17. The article of footwear of claim 1, wherein the first set of traction elements includes a plurality of spikes positioned in an arch region or a midfoot region of the outsole, wherein the plurality of spikes includes at least one spike with a height corresponding to the first maximum height.

18. The article of footwear of claim 1, wherein the outsole comprises a heel region, a midfoot region, and a forefoot region each comprising a central portion and a peripheral portion extending around the central portion, wherein the peripheral portion includes the first and second sets of traction elements, and wherein the central portion includes one or more flat surface areas that do not include any traction elements.

* * * * *